US009360220B2

(12) United States Patent
Chen et al.

(10) Patent No.: US 9,360,220 B2
(45) Date of Patent: Jun. 7, 2016

(54) MICRO-MIXER NOZZLE

(71) Applicant: General Electric Company, Schenectady, NY (US)

(72) Inventors: Wei Chen, Greer, SC (US); Kevin Weston McMahan, Greer, SC (US); Gregory Allen Boardman, Greer, SC (US); Jerome David Brown, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 841 days.

(21) Appl. No.: 13/669,479

(22) Filed: Nov. 6, 2012

(65) Prior Publication Data

US 2014/0123650 A1 May 8, 2014

(51) Int. Cl.

| | |
|---|---|
| ***F23D 14/62*** | (2006.01) |
| ***F23D 14/02*** | (2006.01) |
| ***F23D 14/08*** | (2006.01) |
| ***F23D 14/10*** | (2006.01) |
| ***F23D 11/40*** | (2006.01) |
| ***F23R 3/28*** | (2006.01) |

(52) U.S. Cl.

CPC ..... *F23R 3/286* (2013.01); *F23D 11/40* (2013.01); *F23D 11/402* (2013.01); *F23D 14/02* (2013.01); *F23D 14/08* (2013.01); *F23D 14/10* (2013.01); *F23D 14/105* (2013.01); *F23D 14/62* (2013.01); *F23D 2900/14021* (2013.01)

(58) Field of Classification Search

CPC ..... F23R 3/286; F23D 14/62; F23D 14/02; F23D 14/08; F23D 14/10; F23D 14/105; F23D 2900/14021; F23D 11/40; F23D 11/402

USPC ..... 60/737, 776, 747

See application file for complete search history.

(56) References Cited

U.S. PATENT DOCUMENTS

| | | | | |
|---|---|---|---|---|
| 2003/0010033 | A1* | 1/2003 | Mansour et al. | 60/740 |
| 2004/0000146 | A1* | 1/2004 | Inoue et al. | 60/776 |
| 2012/0031097 | A1 | 2/2012 | McMahan et al. | |
| 2012/0180491 | A1 | 7/2012 | Hadley et al. | |
| 2012/0198856 | A1 | 8/2012 | Uhm et al. | |
| 2012/0210720 | A1 | 8/2012 | McMahan et al. | |

OTHER PUBLICATIONS

U.S. Appl. No. 13/471,488, filed May 15, 2012, Keener, et al.

* cited by examiner

*Primary Examiner* — Kenneth Bomberg
*Assistant Examiner* — Wesley Harris
(74) *Attorney, Agent, or Firm* — Sutherland Asbill & Brennan LLP

(57) ABSTRACT

The present application provides a micro-mixer combustion nozzle for mixing a flow of fuel and a flow of air in a gas turbine engine. The micro-mixer combustion nozzle may include a fuel plate with a number of fuel plate apertures and a fuel plate passage in communication with the flow of fuel and an air plate with a number of air plate apertures and an air plate passage in communication with the flow of air. The fuel plate passage and the air plate passage may align to mix in part the flow of fuel and the flow of air.

6 Claims, 3 Drawing Sheets

MICRO-MIXER NOZZLE

TECHNICAL FIELD

The present application and the resultant patent relate generally to gas turbine engines and more particularly relate to a micro-mixer nozzle with simplified components for ease of manufacturing, ease of configuration, and overall ease of operation.

BACKGROUND OF THE INVENTION

Operational efficiency and overall output of a gas turbine engine generally increases as the temperature of the hot combustion gas stream increases. High combustion gas stream temperatures, however, may produce high levels of nitrogen oxides and other types of regulated emissions. A balancing act thus exists between operating a gas turbine engine in an efficient temperature range while also ensuring that the output of nitrogen oxides and other types of regulated emissions remain below mandated levels.

Lower emission levels of nitrogen oxides and the like may be promoted by providing for good mixing of the fuel stream and the air stream prior to combustion. Such premixing tends to reduce combustion temperatures and the output of nitrogen oxides. One method of providing such good mixing is through the use of a micro-mixer combustion nozzle wherein the fuel and the air are mixed in a number of micro-mixer tubes within a plenum before combustion.

Although current micro-mixer nozzle designs provide improved combustion performance, manufacturing such a micro-mixer nozzle may be challenging. As described above, the micro-mixer nozzle generally includes a number of small tubes with a number of small holes therein. Such components may require tight tolerances and hence may be time consuming to manufacture. Moreover, overall flow distribution may be difficult to control therein.

There is such a desire for an improved micro-mixer combustion nozzle design. Such an improved micro-mixer combustion nozzle design may promote good fuel/air mixing while providing ease of manufacturing, configuration, and use with lower cost components and techniques.

SUMMARY OF THE INVENTION

The present application and the resultant patent thus provide a micro-mixer combustion nozzle for mixing a flow of fuel and a flow of air in a gas turbine engine. The micro-mixer combustion nozzle may include a fuel plate with a number of fuel plate apertures and a fuel plate passage in communication with the flow of fuel and an air plate with a number of air plate apertures and an air plate passage in communication with the flow of air. The fuel plate passage and the air plate passage may align to mix in part the flow of fuel and the flow of air.

The present application and the resultant patent further provide a method mixing a flow of fuel and a flow of air in a combustion nozzle. The method may include the steps of aligning at least in part one or more gas plate passages on a gas plate with one or more air plate passages on an air plate, flowing the fuel through a number of fuel plate apertures into the one or more gas plate passages, flowing the air into the one or more air plate passages, mixing the flow of fuel and the flow of air, and flowing the fuel-air mixture through a number of air plate apertures.

The present application and the resultant patent further provide a micro-mixer combustion nozzle for mixing a flow of fuel and a flow of air in a gas turbine engine. The micro-mixer combustion nozzle may include a fuel plate with a number of fuel plate apertures and a number of fuel plate passages in communication with the flow of fuel and an air plate with a number of air plate apertures and a number of air plate passages in communication with the flow of air. The fuel plate passages and the air plate passages may align in part to mix the flow of fuel and the flow of air into a fuel-air flow therethrough.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
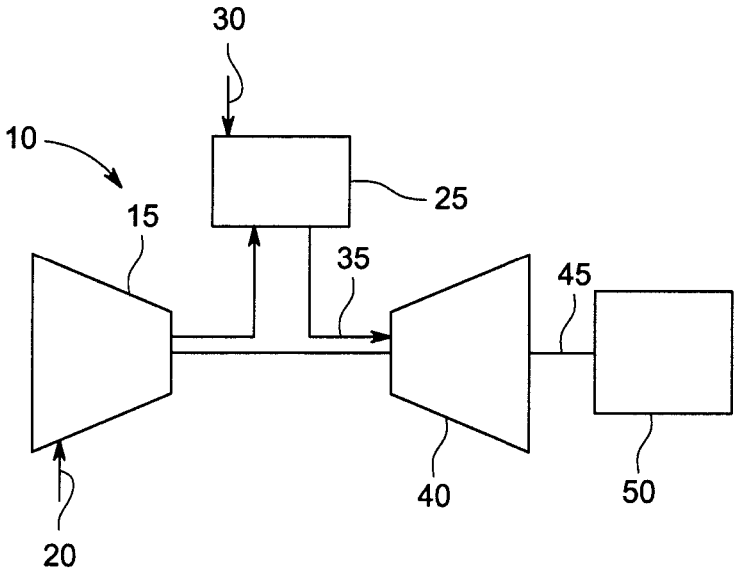
FIG. 1 is a schematic diagram of a gas turbine engine showing a compressor, combustor, a turbine, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of the combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
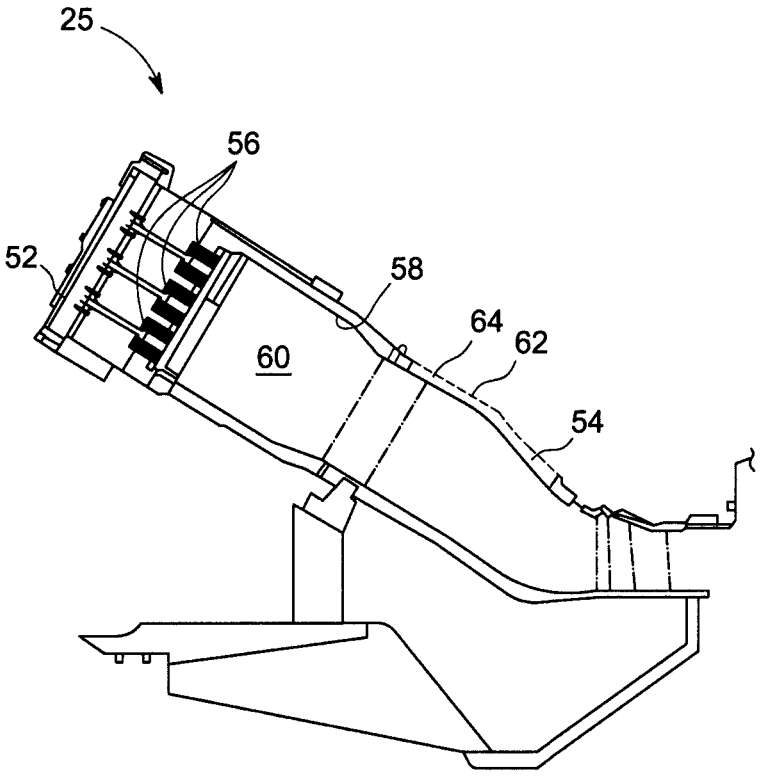
FIG. 2 is a schematic diagram of a combustor as may be used with the gas turbine engine of FIG. 1.

FIG. 2 shows a schematic diagram of an example of the combustor 25 as may be used with the gas turbine engine 10 described above. The combustor 25 may extend from an end cap 52 at a head end to a transition piece 54 at an aft end about the turbine 40. A number of fuel nozzles 56 may be positioned about the end cap 52. A liner 58 may extend from the fuel nozzles 56 towards the transition piece 54 and may define a combustion zone 60 therein. The liner 58 may be surrounded by a flow sleeve 62. The liner 58 and the flow sleeve 62 may define a flow path 64 therebetween for the flow of air 20 from the compressor 15 or otherwise. The combustor 25 described herein is for the purpose of example only. Combustors with other components and other configurations may be used herein.

Figure 3:
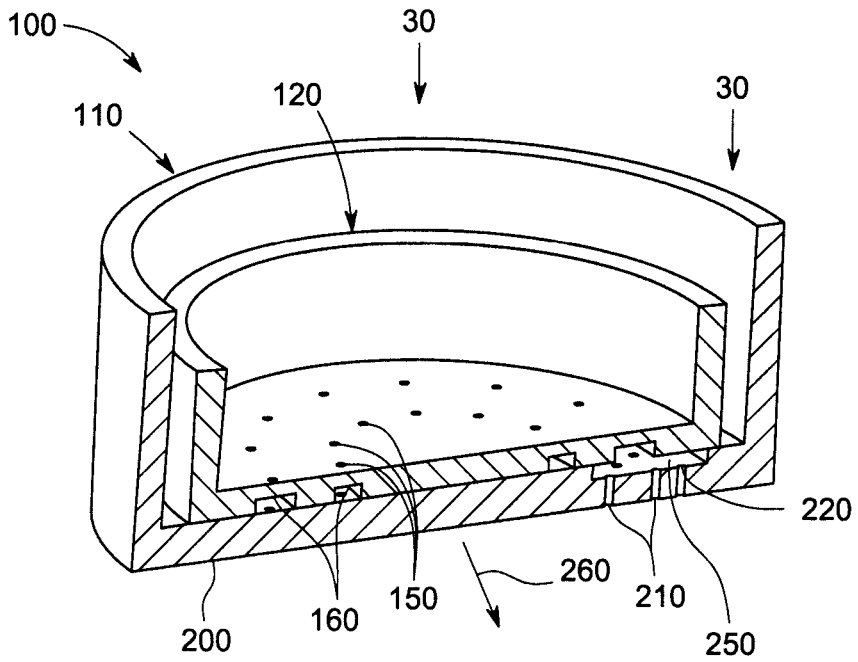
FIG. 3 is a partial perspective view of a micro-mixer nozzle as may be described herein.
Figure 4:
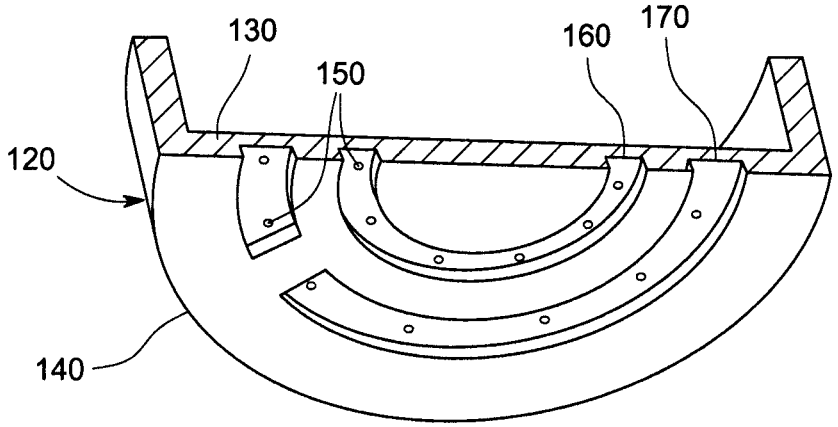
FIG. 4 is a partial perspective of a fuel plate for use with the micro-mixer nozzle of FIG. 3.
Figure 5:
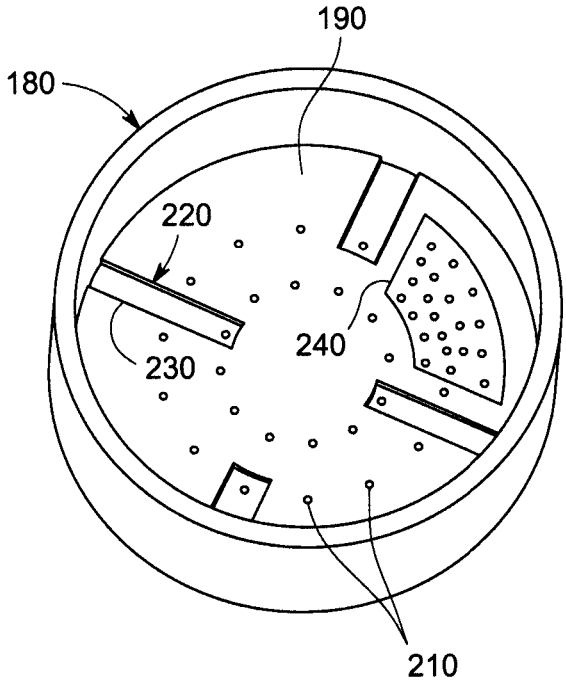
FIG. 5 is a perspective view of an air plate for use with the micro-mixer nozzle of FIG. 3.

FIGS. 3-5 show portions of a combustion nozzle 100 as may be described herein for mixing the flow of air 20 and the flow of fuel 30. The combustion nozzle 100 may be a micro-mixer combustion nozzle 110. The combustion nozzle 100 may be used with the combustor 25 as described above and the like. The combustion nozzle 100 may have any suitable size, shape, or configuration.

The combustion nozzle 100 may include a fuel plate 120. The fuel plate 120 may be in communication with the flow of fuel 30. By use of the term "plate," we are simply referring to the downstream end of the fuel passage. The fuel plate 120 may be combined with many other overall designs. The fuel plate 120 may have as first side 130 and a second side 140. The fuel plate 120 may have as number of fuel plate apertures 150 extending therethrough from the first side 130 to the second side 140. The fuel plate apertures 150 may have any suitable size, shape, or configuration. Fuel apertures 150 of differing sizes and shapes may be used herein together. Any number of the fuel plate apertures 150 may be used herein.

The fuel pate 120 may have a number of fuel plate passages 160 formed therein about the second side 140. The fuel plate passages 160 may be grooved into the second side 140 of the fuel plate 140 or otherwise formed therein. The fuel plate apertures 150 may align with the fuel plate passages 160. In this example, the fuel plate passages 160 take the form of a number of concentric circles 170. The concentric circles 170 may be continuous and/or intermittent. The fuel plate passages 160 may have any suitable size, shape, or configuration. Any number of the fuel plate passages 160 may be used herein. Fuel plate passages 160 of differing sizes and shapes may be used herein together. Other components and other configurations may be used herein.

The combustion nozzle 100 also may include an air plate 180. The air plate 180 may be in communication with the flow of air 20 from the compressor 150 or elsewhere. By use of the term "plate," we are simply referring to the downstream end of the air passage. The air plate 180 may be combined with many other overall designs. The air plate 180 may surround the fuel plate 120 in whole or in part or the respective positions may be reversed. The air plate 180 may include a first side 190 and a second side 200. The second side 140 of the fuel plate 120 may face the first side 190 of the air plate 180. The air plate 180 may have a number of air plate apertures 210 extending therethrough from the first side 190 to the second side 200. The air plate apertures 210 may have any suitable size, shape, or configuration. Any number of the air plate apertures 210 may be used. The air plate apertures 210 generally may not align directly with the fuel plate apertures 150 (although such may be used) but may be offset therefrom. Moreover, differing numbers of air plate apertures 210 and fuel plate apertures 150 may be used herein. Air plate apertures 210 of differing sizes and shapes may be used herein together.

The air plate 180 also may have a number of air plate passages 220. The air plate passages 220 may have any suitable size, shape, or configuration. Any number of the air plate passages 220 may be used herein. The air plate passages 220 may be formed in the first side 190 of the air plate 180. The air plate passages 220 may be grooved into the first side 190 of the air plate 180 or otherwise formed therein. In this example, a number of linear air plate passages 230 may be used herein. Moreover, one or more circular air plate passage segments 240 also may be used. The air plate apertures 210 may be positioned within the linear air plate passages 230 and the circular air plate passage segments 240 and elsewhere. As is shown, air plate passages 220 of differing size and shape may be used herein together. Other components and other configurations may be used herein.

In use, the flow of fuel 30 extends to the fuel plate 120 and passes through the fuel plate apertures 150 and into the fuel plate passages 160 on the second side 140 thereof The flow of fuel 30 may be accelerated as it passes through the small fuel plate apertures 150. The flow of air 20 extends to the air plate 180 and flows through the air plate passages 220. The intertwining of the fuel plate passages 160 and the air plate passages 220 forms a kind of a mixing tube 250 to promote good fuel-air mixing therein in combination with the accelerated flow of fuel 30. A fuel-air mixture 260 thus exits the air plate apertures 210 for combustion in the combustion zone 60. Other components and other configurations also may be used herein.

Figure 6:
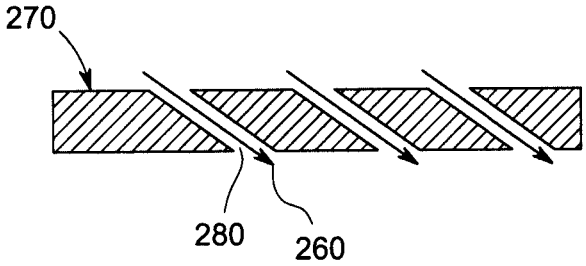
FIG. 6 is a partial side cross-sectional view of an alternative embodiment of an air plate for use with a micro-mixer nozzle as may be described herein.

The size, shape, and configuration of the various apertures and passages may be varied herein. For example, FIG. 6 shows an example of an air plate 270 with a number of angled air plate apertures 280. The angled air plate apertures 280 thus extend at an angle from the first side 190 to the second side 200 of the air plate 270. Any angle may be used herein. The angled air apertures 280 may be used with the air plate apertures 210 that extend perpendicularly from the first side 190 of the air plate 180 as described above. Any combination of air plate apertures may be used herein. The use of the angled air plate apertures 280 may minimize the recirculation of hot gases about the second side 200 of the air plate 270.

Varying the size of the air plate apertures 210 may be used to control flame quenching for the fuel-air mixture 260 passing therethrough. The size of the fuel plate passages 160 and the air plate passages 220 may be varied to control the pressure drop therethrough. Overall tuning of the combustion nozzle 100 also may be provided by altering the sizes and shape of the plates 120, 180, the apertures 150, 210, and the passages 160, 220. The respective apertures 150, 210 and the passages 160, 220 also may be clocked for fine tuning. The respective positions of the fuel plates 220 and the air plate 180 also may be reversed. Different types of fillers may be added to the air passages 220 to maintain the quenching capability to control flame holding. Such fillers may be a catalyst to enhance the chemical reaction therein while inhibiting flame holding. Moreover, layers of the air plates 180 may be used to maintain a quenching distance and increase the flow area of the passages 220. Other components and other configurations may be used herein.

The combustion nozzle 100 described herein thus may provide for ease of manufacture in that the components may be substantially modular. Moreover, the combustion nozzle 100 may be easy to reconfigure. These manufacturing benefits are combined with a number of operation advantages including a very high flame holding limit, low emissions, a short flame for fast combustion, and a lower pressure drop. Specifically, the combustion nozzle 100 provides enhanced control of air and fuel distribution.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A micro-mixer combustion nozzle for mixing a flow of fuel and a flow of air in a gas turbine engine, comprising:

a fuel plate in communication with the flow of fuel, wherein the fuel plate comprises:

a first side and a second side;

a plurality of fuel plate apertures extending through the fuel plate from the first side to the second side; and at least one fuel plate passage formed on the second side of the fuel plate, wherein the at least one fuel plate passage comprise a groove on the second side of the fuel plate, and wherein at least a portion of the plurality of fuel plate apertures are aligned with and exit into the at least one fuel plate passage; and an air plate aligned with the fuel plate and in communication with the flow of air, wherein the air plate comprises:

a first side and a second side;

a plurality of air plate apertures extending through the air plate from the first side to the second side; and at least one air plate passage formed on the first side of the air plate, wherein the at least one air plate passage comprise a groove on the first side of the air plate, wherein at least a portion of the plurality of air plate apertures are aligned with the at least one air plate passage, and wherein the at least on fuel plate passage and the at least one air plate passage at least partially overlap to form a mixing tube;

wherein the flow of fuel passes through the plurality of fuel plate apertures, into the at least one fuel plate passage, and into the mixing tube, where the flow of fuel mixes with the flow of air from the at least one air plate passage to create and air-fuel mixture that exits the plurality of air plate aperatures.

2. The micro-mixer combustion nozzle of claim 1, wherein the at least one fuel plate passage comprises a concentric circle.

3. The micro-mixer combustion nozzle of claim 1, wherein the at least one air plate passage comprises a linear air plate passage.

4. The micro-mixer combustion nozzle of claim 1, wherein the at least one air plate passage comprises a circular air plate passage segment.

5. The micro-mixer combustion nozzle of claim 1, wherein the plurality of air plate apertures are offset from the plurality of fuel plate apertures.

6. The micro-mixer combustion nozzle of claim 1, wherein the plurality of air plate apertures comprise angled air plate apertures.

* * * * *